US005588725A

United States Patent [19]

Frank

[11] Patent Number: 5,588,725

[45] Date of Patent: Dec. 31, 1996

[54] DECORATIVE MULTI-PURPOSE EMERGENCY CABINET

[76] Inventor: Carmella L. Frank, 112 Overlook Dr., East Islip, N.Y. 11730

[21] Appl. No.: 521,523

[22] Filed: Aug. 30, 1995

[51] Int. Cl.[6] ..... A47B 67/02

[52] U.S. Cl. ..... 312/245; 312/204; 312/278; 312/280

[58] Field of Search ..... 312/245, 204, 312/278, 235.1, 279, 281, 282, 280, 114, 117, 138.1

[56] References Cited

U.S. PATENT DOCUMENTS

| | | | |
|---|---|---|---|
| 693,469 | 2/1902 | Wagner et al. | 312/117 |
| 1,996,414 | 4/1935 | Gantt | 312/245 |
| 2,086,643 | 7/1937 | Shearer | 312/204 |
| 3,715,882 | 2/1973 | Ohde | 312/204 |
| 3,930,702 | 1/1976 | Pichowicz | 312/245 |
| 4,319,792 | 3/1982 | Britt et al. | 312/245 |
| 4,799,744 | 1/1989 | Toy | 312/245 |
| 5,251,972 | 10/1993 | Zurawin | 312/114 |
| 5,388,570 | 2/1995 | Wassil | 312/245 |

FOREIGN PATENT DOCUMENTS

| | | | |
|---|---|---|---|
| 79873 | 5/1983 | European Pat. Off. | 312/204 |

*Primary Examiner*—Peter M. Cuomo
*Assistant Examiner*—Hanh V. Tran
*Attorney, Agent, or Firm*—Michael I. Kroll

[57] ABSTRACT

A decorative emergency cabinet (10) comprising a cupboard (12) mountable upon a vertical flat member (14) in an upright position for holding various emergency type articles (16) in one place. During an emergency situation the articles (16) can be retrieved quickly from the cupboard (12) for immediate use. A planter (18) extends outwardly from a lower front portion of the cupboard (12) for holding flowering house plants (20) therein, so as to enhance the decor of the cupboard (12).

1 Claim, 3 Drawing Sheets

DECORATIVE MULTI-PURPOSE EMERGENCY CABINET

BACKGROUND OF THE INVENTION

1. Field of the Invention

The instant invention relates generally to storage cases and more specifically it relates to a decorative emergency cabinet.

2. Description of the Prior Art

Numerous storage cases have been provided in prior art that are adapted to hold various articles therein, such as linens, household supplies, clothes and other small items. While these units may be suitable for the particular purpose to which they address, they would not be as suitable for the purposes of the present invention as heretofore described.

SUMMARY OF THE INVENTION

A primary object of the present invention is to provide a decorative emergency cabinet that will overcome the shortcomings of the prior art devices.

Another object is to provide a decorative emergency cabinet that can be mounted to a wall in a house to hold all types of items needed for emergency situations, such as a first aid kit, a fire extinguisher, a flashlight, candles and the like.

An additional object is to provide a decorative emergency cabinet that will keep the emergency items all in one place, so that during an emergency the items can be retrieved quickly and used immediately.

A further object is to provide a decorative emergency cabinet that is simple and easy to use.

A still further object is to provide a decorative emergency cabinet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
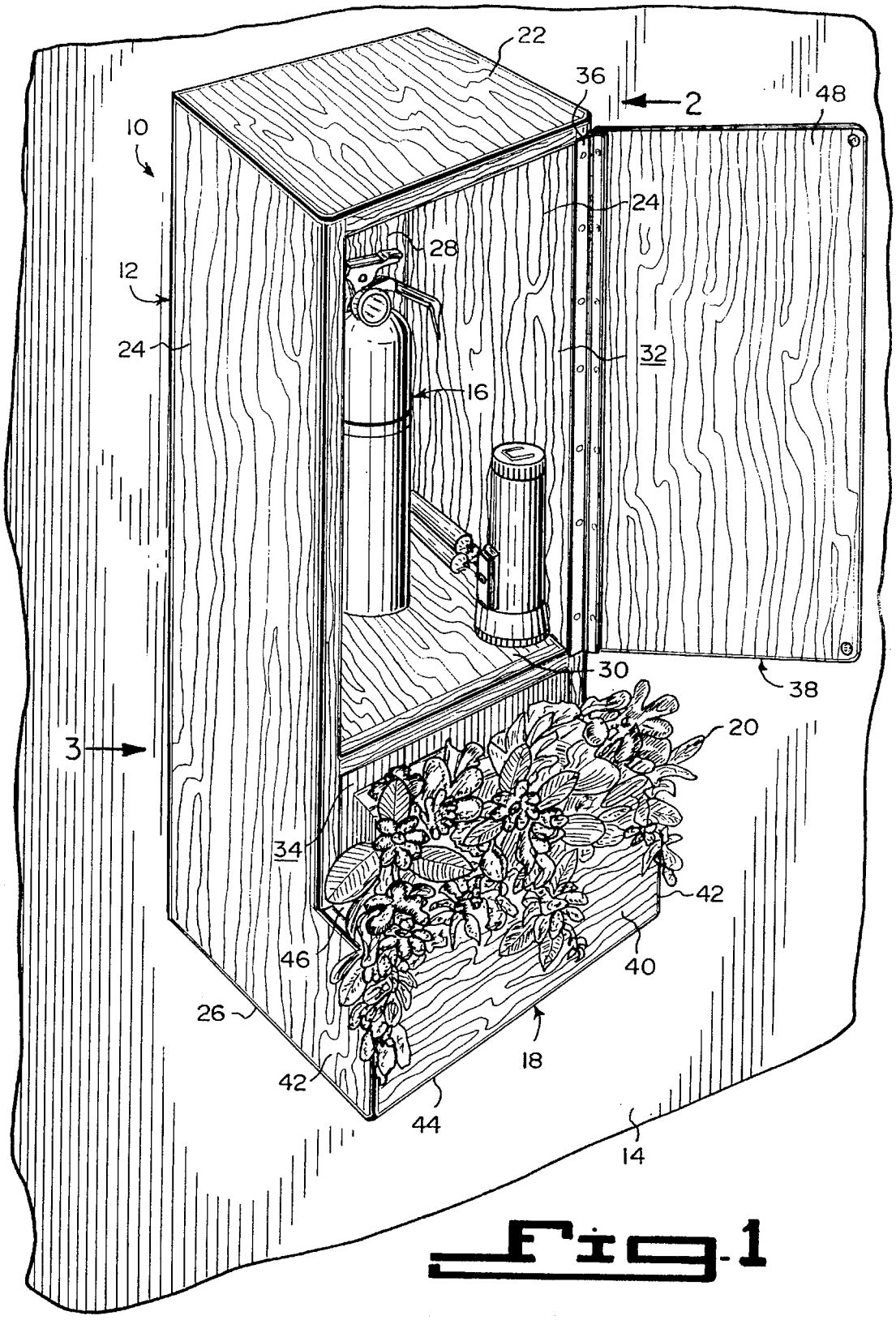
FIG. 1 is a front perspective view of the instant invention mounted onto a wall with the front door open and the flowering house plants in the front planter.
Figure 2:
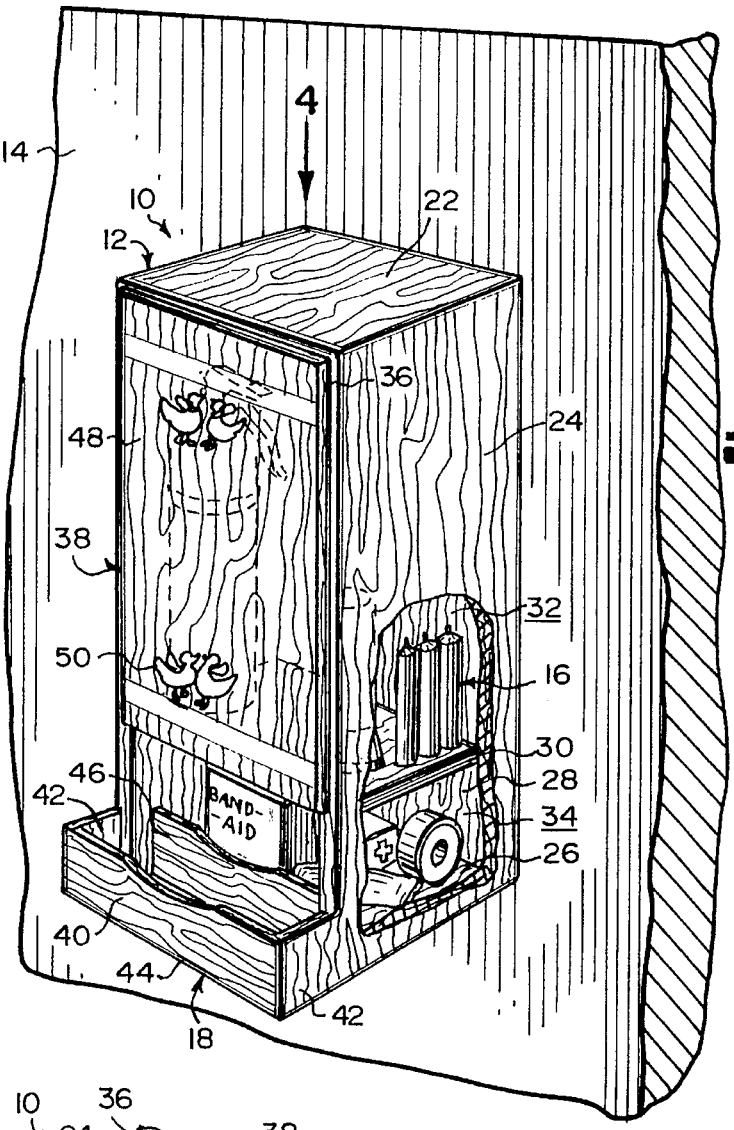
FIG. 2 is a front perspective view taken in the direction of arrow 2 in FIG. 1 with the front door closed, the right side panel broken away and the flowering house plants removed from the planter.
Figure 3:
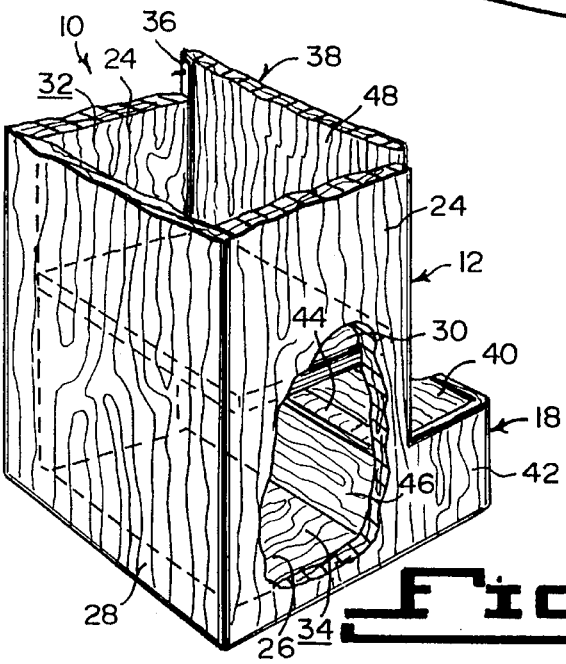
FIG. 3 is a rear perspective view of the lower portion of the instant invention per se taken in the direction of arrow 3 in FIG. 1 with the front door closed, the left side panel broken away and the flowering house plants removed from the front planter.
Figure 4:
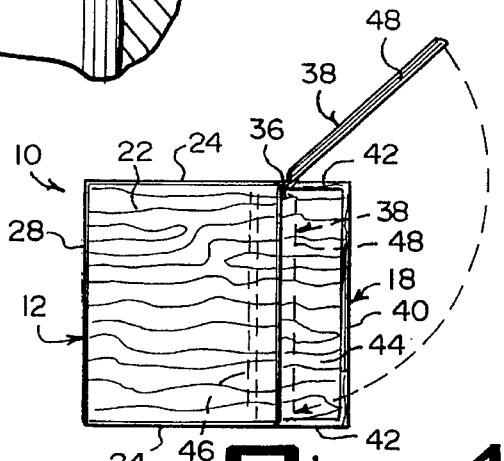
FIG. 4 is a top view of the instant invention per se taken in the direction of arrow 4 in FIG. 2, with the front door open.
Figure 5:
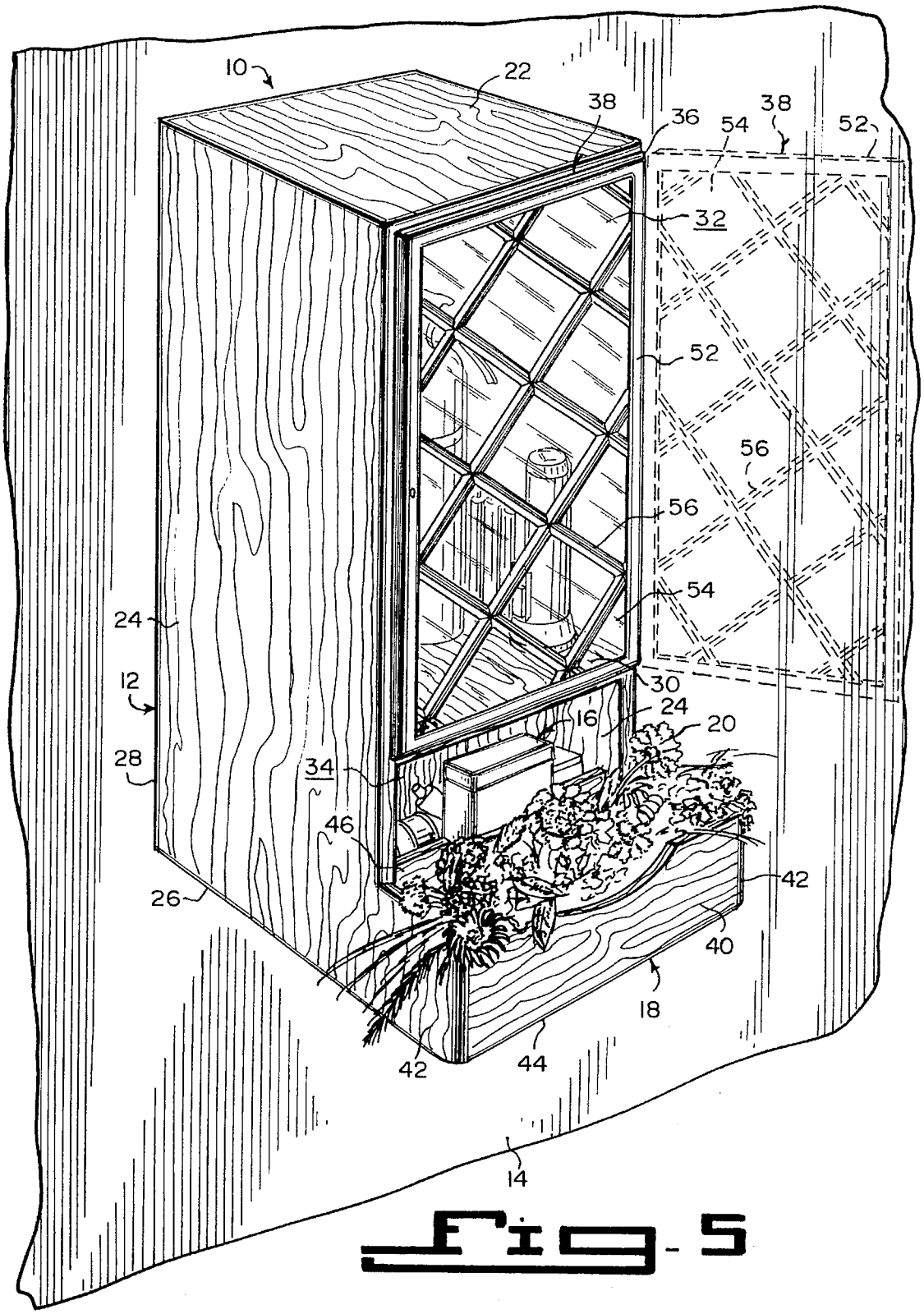
FIG. 5 is a front perspective view similar to FIG. 1, with the front door being transparent and closed.

Turning now descriptively to the drawings, in which similar reference characters denote similar elements throughout the several views, FIGS. 1 through 5 illustrate a decorative emergency cabinet 10 comprising a cupboard 12 mountable upon a vertical flat member 14 in an upright position for holding various emergency type articles 16 in one place. During an emergency situation the articles 16 can be retrieved quickly from the cupboard 12 for immediate use. A planter 18 extends outwardly from a lower front portion of the cupboard 12 for holding flowering house plants 20 therein, so as to enhance the decor of the cupboard 12.

The cupboard 12 includes a top panel 22, a pair of side panels 24, a bottom panel 26 and a rear panel 28, so as to form an open front compartment for storing the emergency type articles 16 therein. The cupboard 12 further includes a shelf 30 about a third of a distance away from the bottom panel 26, so as to form a large storage chamber 32 above the shelf 30, for holding large emergency type articles 16 therein and a small storage chamber 34 below the shelf 30, for holding small emergency type articles 16 therein.

The cupboard 12 further contains a hinge 36 along one free edge of one side panel 24 between the top panel 22 and the shelf 30. A door 38 is connected to the hinge 36, to open and close the large storage chamber 32.

The planter 18 consists of a front wall 40, a pair of side walls 42 and a bottom wall 44, so as to form an open top box for retaining the flowering house plants 20 therein. The side walls 42 of the planter 18 are integral with the side panels 24 of the cupboard 12. The bottom wall 44 of the planter 18 is integral with the bottom panel 26 of the cupboard 12, so that the cupboard 12 and the planter 18 will form one complete whole unit.

The top surface of the planter 18 is spaced away from and below a bottom surface of the shelf 30, so as to allow access into the small storage chamber 34 within the cupboard 12. The cupboard 12 includes a narrow partition 46 on the bottom panel 26 extending between the side panels 24, to separate the planter 18 from the small storage chamber 34. The narrow partition 46 is of the same height as the planter 18, so as to still allow access into the small storage chamber 34.

The door 38, as shown in FIGS. 1 to 4, is made out of one solid piece 48 with decorations 50 thereupon. The door 38 in FIG. 5, includes a frame 52. A transparent pane 54 is carried within the frame 52, so that a person can see the emergency articles 16 within the large storage chamber 32. A decorative lattice 56 is on the transparent pane 54.

The cupboard 12 and the planter 18 are fabricated out of a strong durable material. The strong durable material can be wood. The emergency type articles 16 can be a fire extinguisher, a flashlight, candles for blackouts, batteries for a portable radio, extra batteries for the flashlight, a first aid kit, bandages, burn creams and the like.

The decorative emergency cabinet 10 can be made out of the following materials in addition to wood;

a) plywood;

b) press board;

c) plastic;

d) metal; and e) any other kind of durable materials or combinations thereof.

The instant invention can also be manufactured as follows:

a) with any type of door 38;

b) made in any size; and c) made out of any type of strong durable material.

OPERATION OF THE INVENTION

To use the decorative emergency cabinet 10, the following steps should be taken:

1. Secure the cupboard 12 in an upright position with mounting screws on the vertical flat member 14, which can be a convenient wall located within a house.
2. Open the door 38 and place the larger emergency type articles 16, such as the fire extinguisher, the flashlight and the candles within the large storage chamber 32.
3. Close the door 38.
4. Insert the smaller emergency type articles 16, such as the batteries, the first aid kit, the bandages and burn creams within the small storage chamber 34 behind the narrow partition 46.
5. Place the flowering house plants 20 within the planter 18.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A decorative emergency cabinet mounted upon a vertical flat member in an upright position for holding various emergency type articles in one place, so that during an emergency situation the articles can be retrieved quickly for immediate use comprising:

a) a flat, horizontal top panel, a pair of flat, vertical side panels, and a rear panel forming an open front compartment;

b) a shelf within said compartment about a third of the distance up from said bottom panel dividing said compartment into upper and lower chambers;

c) a hinge along one free edge of one side panel between said top panel and said shelf, and a door connected to said hinge to open and close the upper chamber;

d) planter means comprising said bottom panel extending from said rear panel a sufficient distance beyond said door when closed so as to form a planter in front of said lower chamber and forward of said door when closed for holding flowering house plants therein, said side panels being L-shaped and a vertical front panel to enclose the sides of said planter;

e) means separating said planter from said lower chamber comprising a narrow partition on the bottom panel extending between the side panels and being of the same height as said planter for gaining access to said lower chamber;

f) said door including a transparent pane with a decorative lattice thereon.

* * * * *